US008066401B2

(12) United States Patent
Leung et al.

(10) Patent No.: US 8,066,401 B2
(45) Date of Patent: Nov. 29, 2011

(54) LIGHT RETAINER ASSEMBLY

(76) Inventors: Benson Chung-Pun Leung, Kwai Chung (HK); Ambrose Shing-Yin Leung, Kwai Chung (HK)

( * ) Notice: Subject to any disclaimer, the term of this patent is extended or adjusted under 35 U.S.C. 154(b) by 124 days.

(21) Appl. No.: 12/290,399

(22) Filed: Oct. 30, 2008

(65) Prior Publication Data

US 2010/0110669 A1 May 6, 2010

(51) Int. Cl.
*F21L 4/00* (2006.01)

(52) U.S. Cl. ..... 362/186; 362/157; 362/190

(58) Field of Classification Search ..... 362/157, 362/186, 190, 191, 208, 253, 457, 458, 312, 362/313, 314, 315, 316, 376, 377, 378, 363; 292/194, 195, 202, 203, 204, 210, 304
See application file for complete search history.

(56) References Cited

U.S. PATENT DOCUMENTS

| | | | | | |
|---|---|---|---|---|---|
| 1,168,724 | A | | 1/1916 | Hartford et al. | |
| 1,480,171 | A | | 1/1924 | McDade | |
| 2,533,910 | A | | 12/1950 | Barr | |
| 3,201,162 | A | * | 8/1965 | Paynor | 292/202 |
| 3,767,904 | A | | 10/1973 | Cook | |
| 3,767,911 | A | | 10/1973 | Oakley et al. | |
| 3,909,888 | A | * | 10/1975 | Funston et al. | 24/586.11 |
| 4,388,674 | A | * | 6/1983 | Sano | 362/186 |
| 4,564,890 | A | | 1/1986 | Poyer | |
| 4,663,697 | A | | 5/1987 | Stearns et al. | |
| 4,692,848 | A | * | 9/1987 | Poyer | 362/216 |
| 4,787,018 | A | | 11/1988 | Poyer | |
| 4,885,670 | A | * | 12/1989 | Baake | 362/400 |
| 5,189,339 | A | * | 2/1993 | Peshak | 315/58 |
| 5,192,126 | A | | 3/1993 | Remeyer et al. | |
| 5,490,045 | A | * | 2/1996 | Lindner | 362/35 |
| 5,588,738 | A | | 12/1996 | Meoli | |
| 5,738,438 | A | | 4/1998 | Hesprich | |
| 5,860,729 | A | | 1/1999 | Bamber | |
| 5,860,730 | A | | 1/1999 | Hesprich | |
| 5,921,658 | A | | 7/1999 | Kovacik et al. | |
| 6,099,144 | A | * | 8/2000 | Klaus | 362/263 |
| 6,296,375 | B1 | | 10/2001 | Sung et al. | |
| 6,328,457 | B1 | * | 12/2001 | Huang | 362/353 |
| 6,572,247 | B2 | * | 6/2003 | Liu | 362/311.06 |
| 7,014,459 | B2 | | 3/2006 | Long | |
| 7,033,065 | B2 | | 4/2006 | Leung et al. | |
| 7,202,614 | B2 | | 4/2007 | Bayat et al. | |
| 7,611,265 | B2 | * | 11/2009 | Laporte | 362/267 |

OTHER PUBLICATIONS

Coleman 8D Claslsic Twin U-tube Lantern, 5329A700, www.campinglanterns.net, Mar. 18, 2008.
Coleman 8D Retro Lantern With Remote Control, 5312-790, www.campinglanterns.net, Jan. 9, 2008.
Replacement Parts—LED/Bulbs, www.campinglanterns.net, Jan. 9, 2008.
Battery Powered Lanterns, www.campinglanterns.net, Jan. 9, 2008.
Coleman 4d Rugged U-tube Lantern, www.campinglanterns.net, Jan. 9, 2008.
Coleman Lantern, www.basspro.com, Jan. 9, 2008.
Coleman Lantern, www.basspro.com, Jan. 9, 2008.

* cited by examiner

*Primary Examiner* — David Crowe
(74) *Attorney, Agent, or Firm* — Bishop & Diehl, Ltd.

(57) ABSTRACT

Light emitting devices having unitary and simplified construction for securing a lighting assembly within the device, and ease of replacement of the light emitting element of the lighting assembly. The lighting assembly is mounted within the light emitting device though use of a fastener.

5 Claims, 7 Drawing Sheets

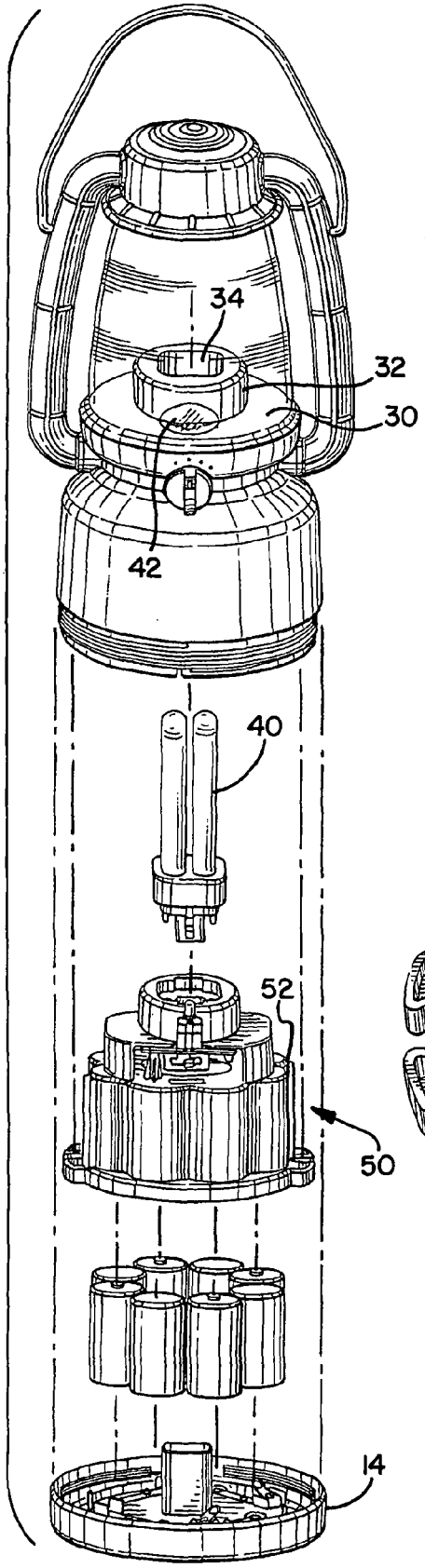
FIG. 2
FIG. 3
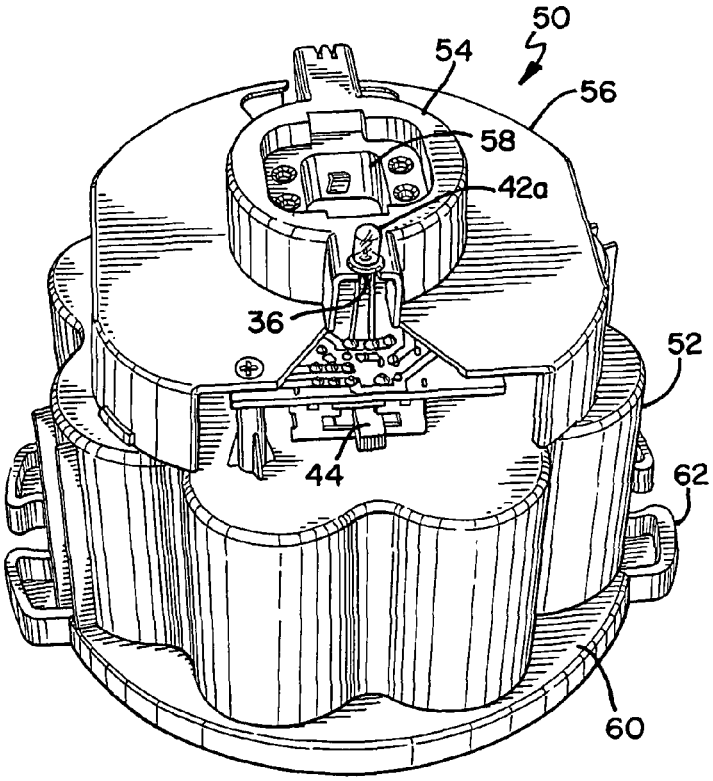

LIGHT RETAINER ASSEMBLY

CROSS-REFERENCE TO RELATED APPLICATIONS

None.

FEDERALLY SPONSORED RESEARCH OR DEVELOPMENT

Not Applicable.

TECHNICAL FIELD

The invention relates to light emitting devices, and in particular portable lanterns, having a simplified construction. The simplified construction allows a user to replace a light emitting element positioned inside the device without displacing the transparent protective cover from the device, or conducting a complicated disassembly of the device to gain access to the light emitting element.

BACKGROUND OF THE INVENTION

Lanterns and handheld lighting devices allow one to provide light where no installed light fixtures exist, for example, while camping, on outdoor patios, decks or pools, or where installed light fixtures provide inadequate lighting. Prior art lanterns and lighting devices allow the light emitting element, such as a fluorescent bulb or incandescent bulb, to be accessed and removed from the lantern. However, the prior art lanterns and lighting devices require disassembly of the lantern itself, to allow access to and replacement of the light emitting element from the lantern. For example, as shown in U.S. Pat. Nos. 5,860,729 and 7,202,614, access and removal of the light emitting element requires removal and handling of the transparent globe or cover. Alternatively, a top cover may be removed, as shown in U.S. Pat. No. 4,663,697, which allows limited access to the light emitting element inside the transparent cover. Moreover, the lanterns of the prior art require reassembly and handling of several components of the lantern after an old light emitting element is replaced with a new one. The disassembly and reassembly of the lantern is time-consuming and requires the user to be capable of reassembling the device without misplacing the various components.

The prior art describes separating the globe from the lantern without removing the globe. As shown and described in U.S. Pat. No. 7,014,459, the globe separates from the base of the lantern. While the globe is not removable and does not require reassembly, the globe must be separated from the lantern base to gain access to the light emitting element positioned inside the globe. The globe assembly must be kept open in order for a user to gain access to the light emitting element. Furthermore, slide rails impede access to the light emitting element as does the globe mounted to the rails.

SUMMARY OF THE INVENTION

The present invention relates to a light emitting device having a simplified construction that allows easy and efficient access to a light emitting element positioned inside the light emitting device. A lighting assembly having a light emitting element and a power supply is removably inserted and secured within the light emitting device. The present invention also relates to a fastener for securing the lighting assembly within the light emitting device. In one embodiment, the fastener may be mounted to or formed as part of the lighting assembly. In another embodiment, the fastener may be mounted to or formed as part of the light emitting device. Furthermore, the fastener may be a lock, latch, or other suitable device that allows the lighting assembly to be removably secured within the lantern body.

A further embodiment of the present invention relates to the lighting assembly, which secures a light emitting element therein. The lighting assembly includes at least one socket for receiving at least one light emitting element, such as a fluorescent bulb or incandescent bulb, or other suitable light emitting element. The lighting assembly is configured to position the light emitting element inside the light emitting device.

A further embodiment of the present invention relates to a light emitting device having a unitary construction. The unitary body may include a bottom cavity for receiving the lighting assembly. The body may further include a base and a platform. The lighting assembly inserted through the base and into the cavity may be positioned adjacent the platform. The platform includes an opening for receiving the light emitting element when the lighting assembly is positioned within the cavity. The unitary body of the lantern may also include a transparent cover that allows light to escape from the interior of the unitary body. The lighting assembly is positioned within the unitary body such that the socket is positioned adjacent to the opening, securing the light emitting element inside the transparent protective cover in the event the device is jarred or dropped.

The present invention allows a user of the light emitting device to simply and efficiently gain access to and replace the light emitting element with minimal disassembly of the lighting device. Additionally, the simplified construction allows users of all skill levels and experience to disassemble and reassembly the light emitting device easily and efficiently.

Additional features and advantages of the present invention are described in, and will be apparent from, the drawings and detailed description.

BRIEF DESCRIPTION OF THE DRAWINGS

To understand the present invention, it will now be described by way of example, with reference to the accompanying drawings in which:

FIG. 2 is an exploded view of the light emitting device of the present invention;

FIG. 3 is a perspective view of the lighting assembly of the present invention;

DETAILED DESCRIPTION

Figure 1:
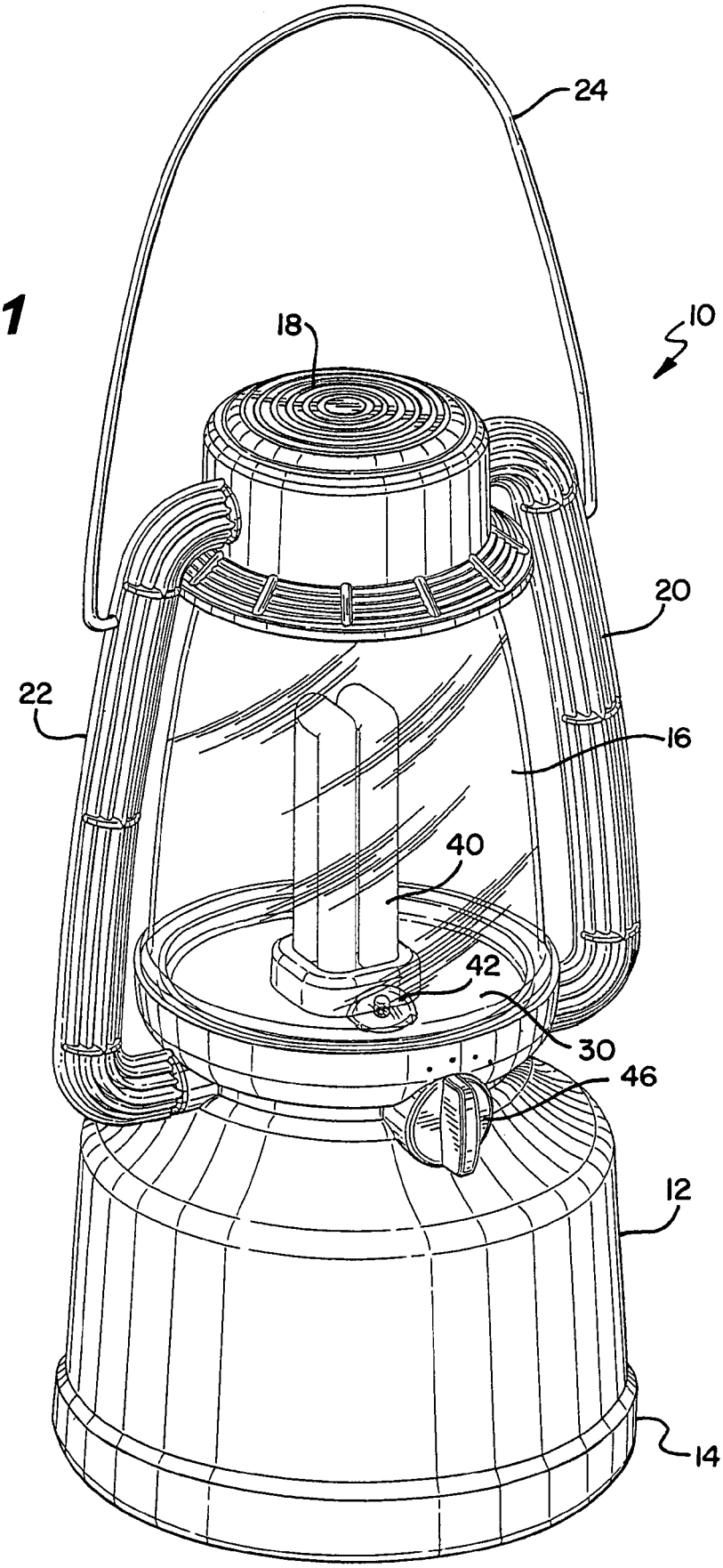
FIG. 1 is a perspective view of the light emitting device of the present invention.

Referring to FIG. 1, a light emitting device 10 includes a base 12, a transparent protective cover 16 mounted to and extending from the base 12, a top cover 18, a bottom cover 14 and a lighting assembly 50. Preferably, the light emitting device is a unitary construction, wherein the base 12, protective cover 16 and top 18 are all permanently affixed to one another. The base 12 further includes a cavity 38 with an open end 39 for receiving a light assembly 50, which will be described in further detail below. The bottom cover 14 removably attached, typically by rotation of the cover, to the base for closing the open end 39 of the base 12.

The light emitting device preferably includes at least one handle, so that the user can hold conveniently onto the device. A first side handle 20 and optionally a second side handle 22 are mounted to and extend between the top cover 18 and base 12, respectively. The first and second side handles 20, 22 are preferably mounted to opposite sides of the light emitting device 10. The single handle or plurality of handles may be mounted to any part of the light emitting device in any configuration without departing from the scope of the invention.

In a preferred embodiment, a top handle 24 is included. The top handle 24 may be pivotally mounted to the first handle 20 and second handle 22 such that a user may grasp the handle in an upright position for carrying or hanging the device. Alternatively, the top handle 24 may be mounted to the top cover 18, base 12, or protective cover 16, or other suitable portion of the light emitting device 10.

The light emitting device may be formed of any polymeric material or similar material suitable for constructing such a device, as is well known in the art. The top handle 22 is preferably made of metal, hard polymeric material, or other suitable material, as is also well known in the art.

The light emitting device 10 further includes a platform 30 mounted to or formed in the base 12 and located within the transparent cover 16. The platform 30 is positioned to divide the base 12 from the transparent cover 16. The platform 30 includes an opening 32 formed therein. The opening 32 is surrounded by a collar 34, the collar preferably raised above the plane of the platform. The opening 32 is designed for receiving a light emitting element 40, such that the light emitting element extends through the opening 34 to reside within the protective cover 16 and the collar 34. Alternatively, a plurality of openings may be formed in the platform 30 to accommodate a plurality of light emitting elements 40.

The platform 30 further includes a secondary opening 36 having a secondary cover 42. The secondary opening 36 receives a secondary light 42*a*. The secondary cover 42 may be color tinted such that when the secondary light 42*a* is turned on, it can function as a night light. Optionally, the secondary cover 42 may be clear, while the secondary light 42*a* may be tinted. The secondary light 42*a* may be any suitable type of light emitting element as described earlier.

Referring to FIGS. 2 and 3, a lighting assembly 50 is shown. The lighting assembly includes a top portion 56 for receiving light emitting element 40 and a hollow base 52 for receiving a power supply. A pedestal 54 is formed on or mounted to the top portion 56. A socket 58 is formed in pedestal 54 for receiving light emitting element 40. The socket 58 is preferably configured to receive a light emitting element having a standard connector, such as fluorescent bulb, or any other type of light emitting element, such as an incandescent bulb, light emitting diode, or other suitable element for emitting light. Alternatively, a plurality of sockets for receiving a plurality of light emitting elements may be provided in a single pedestal or multiple pedestals at the top portion 56.

Figure 4:
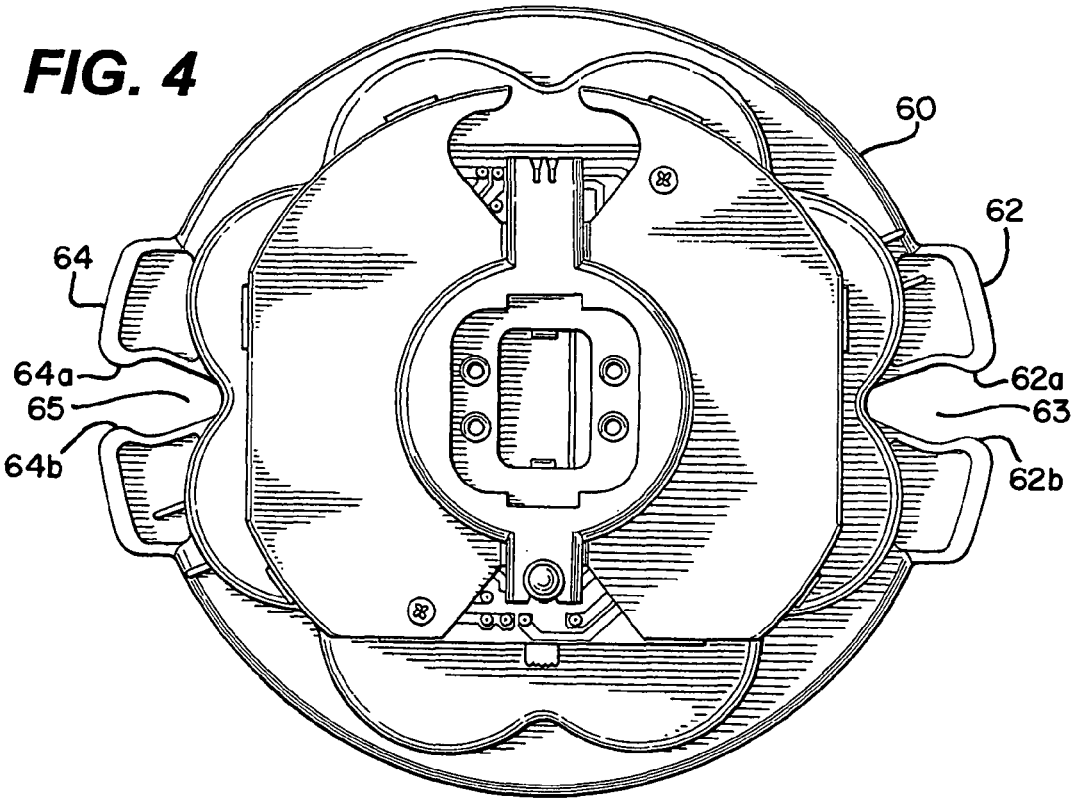
FIG. 4 is a top view of the lighting assembly.
Figure 5:
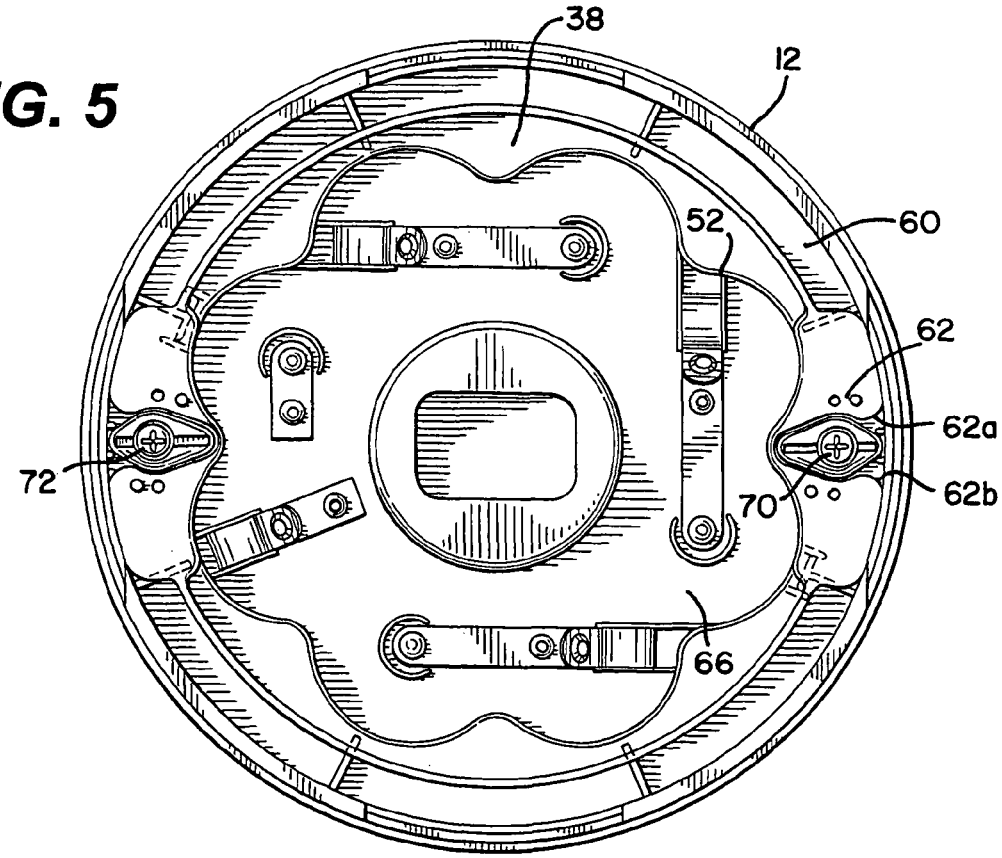
FIG. 5 is a bottom view of the light emitting device of the present invention with the lighting assembly inserted therein.

Referring to FIGS. 4 and 5, lighting assembly 50 further includes a hollow base 52. Extending from the base 52 is a bottom edge 60. A shoulder 62 is formed in the bottom edge 60. The shoulder 62 may be formed as a single shoulder 62*a* or as a dual shoulder 62*a*, 62*b*. An opening 63 is formed in the shoulder 62. The opening may be formed between dual shoulder portions 62*a*, 62*b*, in the edge 60, or partially formed in the edge 60 and either or both of shoulder portions 62*a*, 62*b*. Additionally, the edge 60 may include a second shoulder 64. The second shoulder 64 may be formed as a single shoulder 64*a* or as a dual shoulder 64*a*, 64*b*. An opening 65 is formed between dual shoulder portions 64*a*, 64*b*, in the edge 60, or partially formed in the edge 60 and either or both of the shoulder portions 64*a*, 64*b*. It will be appreciated that a single shoulder or plurality of shoulders may be used without departing from the scope of the present invention. As will be described, the shoulder or shoulders cooperate with the fastener to secure the lighting assembly 50 within the base 12 of the light emitting device 10.

Referring to FIG. 5, base 52 also includes a power supply compartment 66 formed therein. The power supply compartment 66 is configured to store a power supply (not shown) for the lighting assembly 50. Preferably, the power supply is a battery, or plurality of batteries, but may also include an AC power adaptor, or other suitable power supply. The bottom cover 14 encloses the open end of the base 12, and secures the power supply within the base 52 when lighting assembly 50 is positioned within the base 12.

The lighting assembly 50 with the light emitting element 40 attached is slidably and removably received inside the cavity 38 through the open end 39 of the base 12. The lighting assembly slides into the cavity 38 until the pedestal 54 is positioned adjacent to the raised collar 34. Optionally, the pedestal 54 may be shaped to slide inside and engage the raised collar 34. The socket 58 formed in pedestal 54 is positioned adjacent to the opening 32 formed in collar 34. The light emitting element 40 positioned in the socket 58 extends through the opening 32 and into the protective cover 16. The collar 34 engages the pedestal 54 further securing the light emitting element 40 within the protective cover 16, such that even if the light emitting element loosens from the socket 58, the light emitting element would not enter the protective cover and be free to loosely rattle around should the device be jarred or dropped.

Upon sliding the lighting assembly 50 into cavity 38, the switch 44 located in the top portion 56 of the lighting assembly 50 engages a knob 46. The switch 44 and the knob 46 couple together such that rotational movement of knob 46 corresponds to sliding movement of switch 44. A user may select between several operational settings, including on/off, nightlight, and high and low power settings, by movement of knob 46. It will also be appreciated that other configurations of the knob 46 and switch 44 may be employed. For example, the knob 46 and switch 44 may be configured to pivot, slide, or other combinations known in the art, without departing from the scope of the invention.

Once the lighting assembly is positioned inside the cavity 38, it may be secured through a fastener. In one embodiment, the fastener is at least one lock 70. Preferably, a second lock 72 may be used. Referring to FIG. 5, the lock 70 is mounted to the inside of base 12 and extends into the cavity 38. Similarly, if a second lock 72 is used, it likewise is mounted to the inside of base 12 and extends into cavity 38. It will be appreciated that other constructions of fasteners may be used, and a single lock or a plurality of locks may be used without departing from the scope of the invention.

Figure 7:
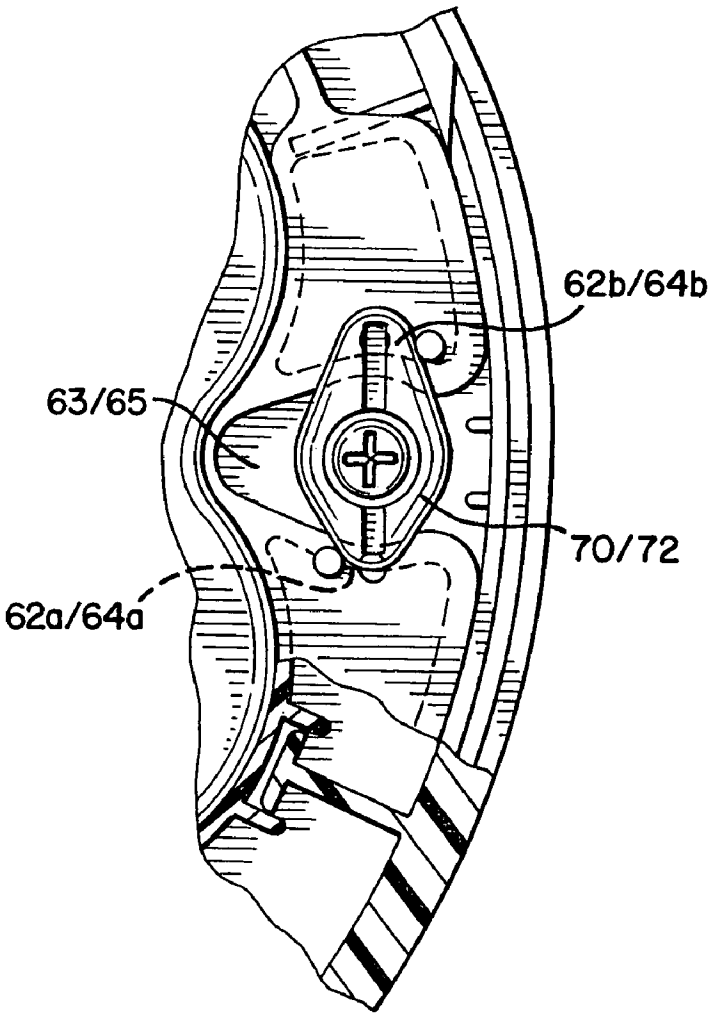
FIG. 7 is a close-up view of the fastener in the closed, secured position.
Figure 6:
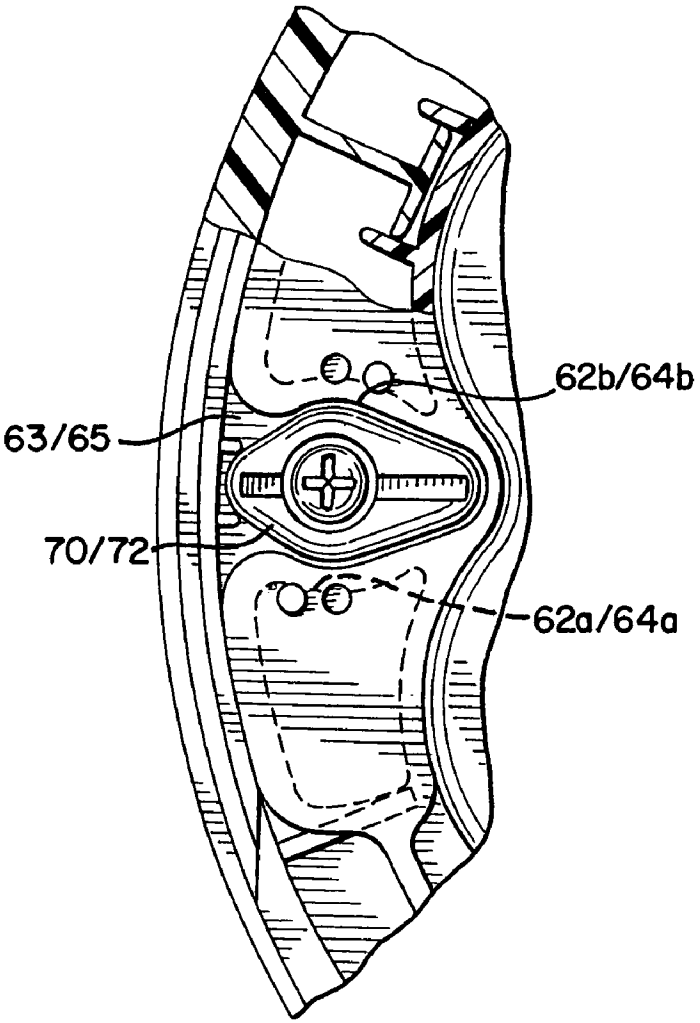
FIG. 6 is a close-up view of the fastener in the open position.

Referring to FIGS. 6 and 7, as the lighting assembly 50 slides into the cavity 38, the first lock 70 slides through an opening 63 for engagement with the shoulder 62. Likewise, the second lock 72 slides through the opening 65 for engagement with the bottom of shoulder 64. As discussed below, the lock 70 may be mounted to either the base 12 or the lighting assembly 50. Likewise, the shoulder 62 may be formed in the other of the base 12 or lighting assembly 50. In either case, the lock 70 is rotated about a pivot axis to engage shoulder 62. The second lock 72 formed in either the base 12 or the lighting assembly 50, may also be rotated to engage the second shoulder 64 formed in the other of the base 12 or lighting assembly 50. Locks 70, 72 may be shaped such that when rotated, locks 70, 72 engage dual shoulder portions, 62*a*, 62*b* and 64*a*, 64*b*, respectively. Locks 70, 72 secure the lighting assembly 50 within the base 12.

To remove the lighting assembly 50 from within cavity 38, the locks 70, 72 are rotated to disengage the first shoulder 62 and second shoulder 64. Once the locks 70, 72 disengage the shoulders, the locks are positioned to slide through the openings 63, 65, respectively. Thus, a user may slide the entire lighting assembly 50 as one piece from inside the cavity 38 to replace the light emitting element 40.

In another embodiment, lock 70 is mounted to lighting assembly 50. Additionally, a shoulder is formed in the base 12 for receiving the lock 70 to secure the lighting assembly within the base 12. It will be appreciated that more than one lock may be mounted to lighting assembly 50, and more than one shoulder may be formed in base 12 without departing from the scope of the present invention. It will be further appreciated that the lock may be mounted to both the base 12 and lighting assembly 50, and each lock corresponds to and cooperates with a shoulder formed in the lighting assembly 50 or base 12, respectively, for securing the lighting assembly within the cavity 38.

Figure 8:
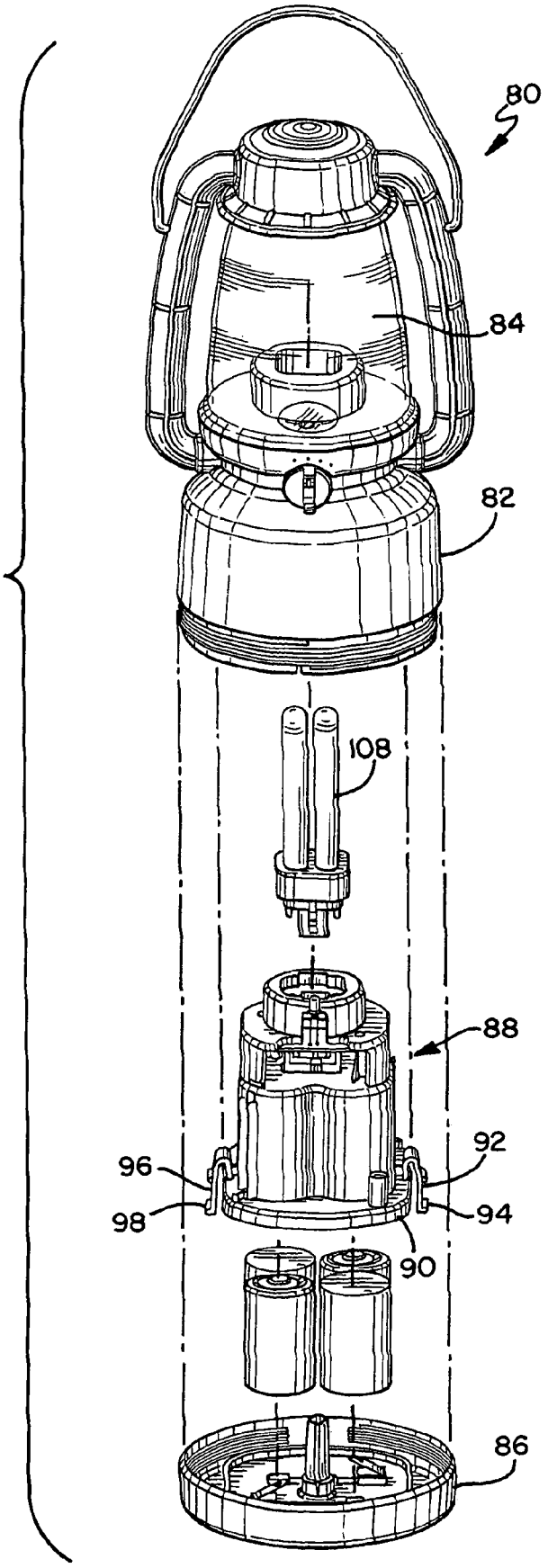
FIG. 8 is a an exploded view of a second embodiment of the light emitting device.

In yet another embodiment of the present invention shown in FIG. 8, the light emitting device 80 includes similar features of a base 82 having a cavity, a transparent protective cover 84, a bottom cover 86 and a lighting assembly 88 having an edge 90, as previously described. In this embodiment, however, the fastener may include a first latch 92, which extends from edge 90 of the lighting assembly and/or base 82 of the light emitting device 80. The latch 92, which is preferably flexible, further includes a first tab 94. Preferably, a second latch 96 may be provided on the edge 90 and/or base 82. The second latch 96 also includes a second tab 98. It will be appreciated that a single latch or a plurality of latches may be used without departing from the scope of the invention.

Figure 9:
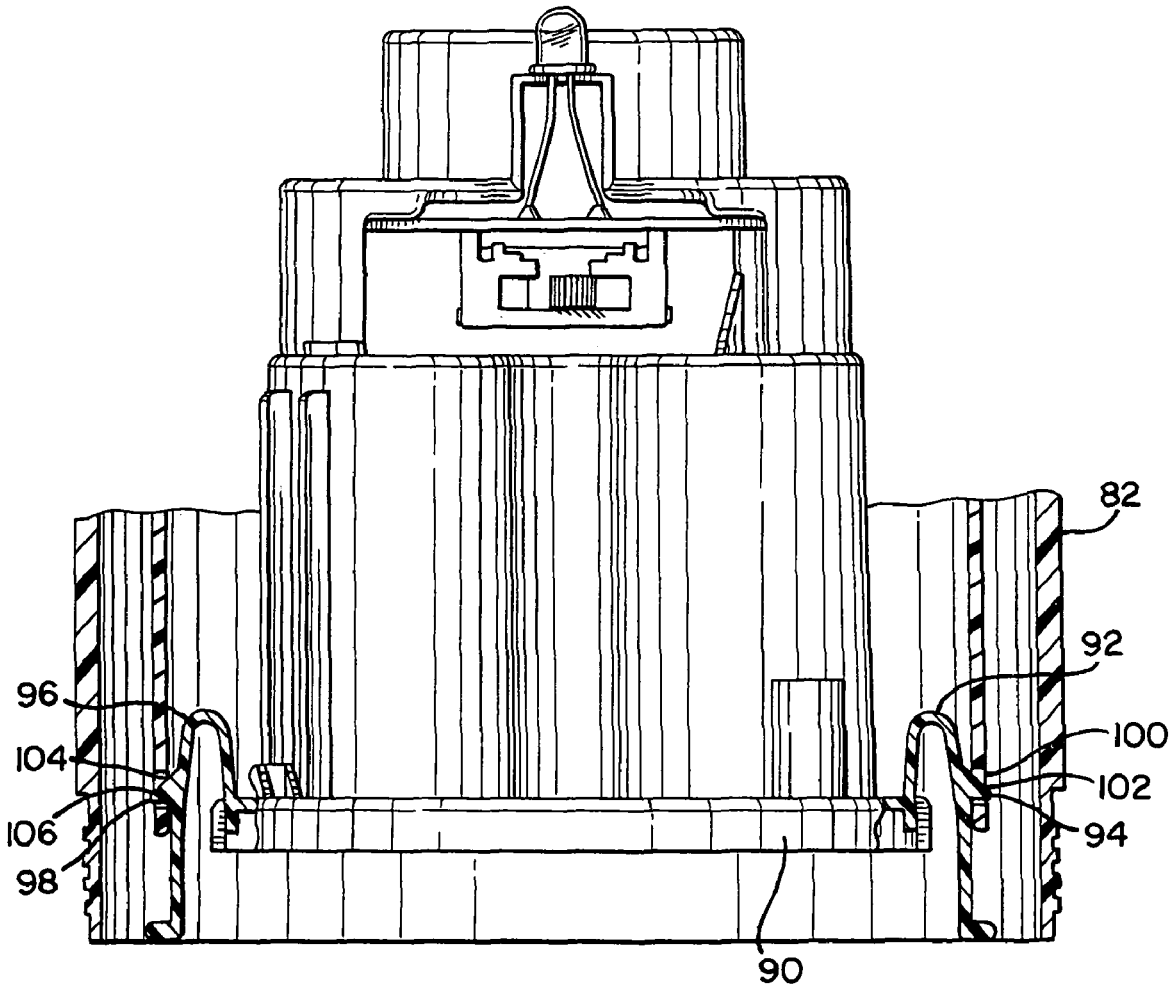
FIG. 9 is front cutaway view of the lighting assembly of the second embodiment of the light emitting device with the fasteners in the secured position.

Referring to FIG. 9, a receiver 100 is mounted to the inside of base 82. The receiver 100 includes a slot 102 for receiving the first latch 92 and engaging the first tab 94. A second receiver 104 may also be mounted to the inside of base 82. The second receiver 102 includes a slot 106 for receiving the second latch 96 and engaging the second tab 98. Thus, when the lighting assembly 88 of the second embodiment is slid inside the cavity of the base 82, the latch cooperates with the slot of the receiver. The tab engage the respective slot locking the lighting assembly 88 into the base 82 of the light emitting device 80. It will be appreciated that a single receiver or a plurality of receivers may be used without departing from the scope of the invention.

Figure 10:
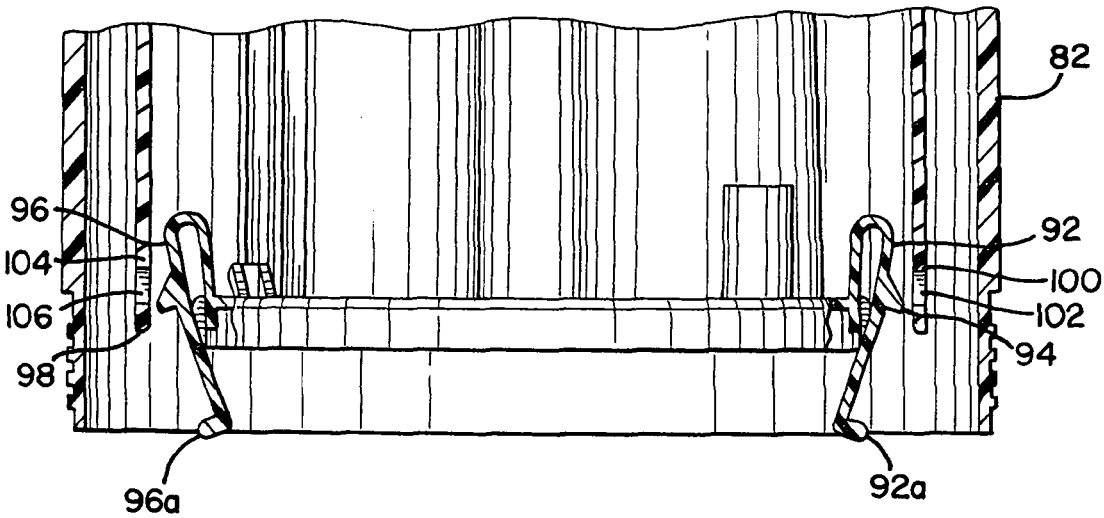
FIG. 10 is a side view of the fasteners of the second embodiment of the present invention in the released position.
Figure 11:
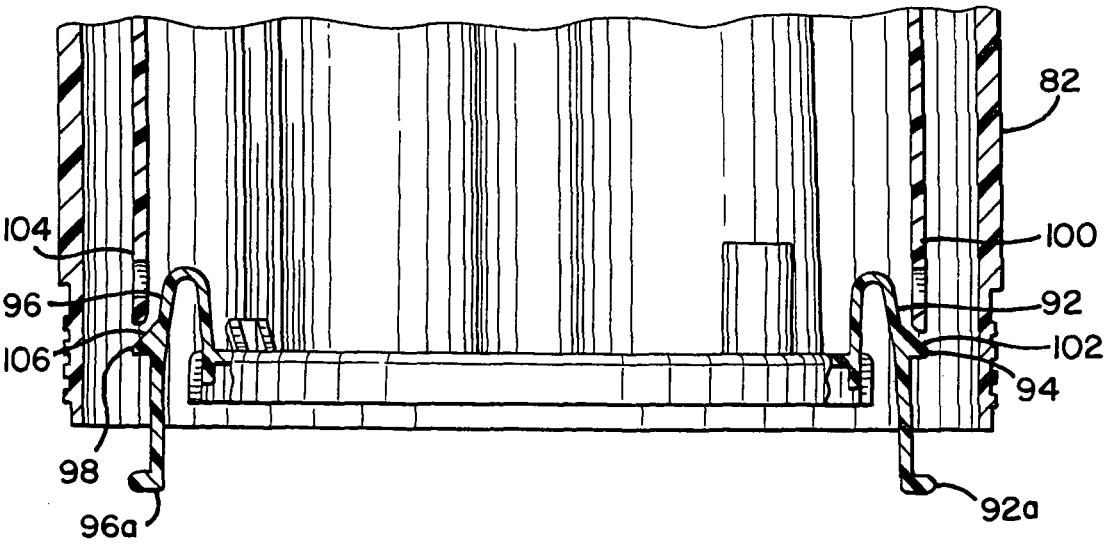
FIG. 11 is a side view of the fasteners of the second embodiment of the present invention in the released position.

As shown in FIGS. 10 and 11, to remove the lighting assembly 88 from within base 82, for example, to change the light emitting element, the latch or latches are released from the slot or slots, respectively. To release the latch 92, a user grasps the latch and presses inward a distal end 92*a* to release the first tab 94 from slot 102. Likewise, if second latch 96 is provided, a user grasps and presses inward distal end 96*a* to release the second tab 98 from slot 106. Once the tab(s) is released from slot(s), the lighting assembly 88 may be slid out of the base 82. The light emitting element 108 may then be replaced by conventional removal from the socket.

In another embodiment, the latch may be mounted to base and extends into cavity of the base. Additionally, the receiver having the slot formed therein is mounted to the lighting assembly. The latch and receiver cooperate to secure the lighting assembly within the base, as previously described. It will be appreciated that more than one latch may be mounted to base and more than one receiver may be mounted to lighting assembly without departing from the scope of the present invention. It will further be appreciated that the latches may be mounted to both the base and the lighting assembly, and the receivers may be mounted to both the base and the lighting assembly that correspond to and cooperate with the latches without departing from the scope of the present invention.

It is understood that various fasteners may be employed without departing from the scope of the present invention and without diminishing the attendant advantages. Alternative fasteners include, but are not limited to, sliding latch and locking mechanisms, spring mounted latch and locking mechanisms, and other locking and fasteners not specifically described but considered part of the present invention described herein. Preferably, whichever securing mechanism is used, it can be engaged and disengaged with the user's hands or fingers, without requiring the use of extra tools.

It is understood that various changes and modifications to the presently preferred embodiments described herein will be apparent to those skilled in the art. Such changes and modifications may be made without departing from the spirit and scope of the present invention and without diminishing its advantages. Therefore, it is intended that such changes and modifications be covered by the appended claims.

What is claimed is:

1. A lantern comprising:

a body comprising a transparent cover connected to a base with a cavity;

at least one handle connected to the body;

a lighting assembly having a top portion for engaging a light emitting element and a compartment for receiving a power supply, wherein the lighting assembly is slidably inserted within the base cavity; and a fastener movably mounted to one of the base or the lighting assembly for securing and releasing the lighting assembly within the cavity, wherein the fastener pivotally cooperates with a shoulder on the other of either the base or the lighting assembly for securing and releasing the lighting assembly within the cavity.

2. The lantern of claim 1, wherein the top portion of the lighting assembly further comprises a socket for receiving the light emitting element.

3. The lantern of claim 1, wherein the lighting assembly further comprises a controller for selectively supplying power to the light emitting element.

4. The lantern of claim 3, further comprising a knob pivotably mounted to the base, wherein the knob couples with the controller to selectively supply power to the light emitting element through pivotal movement of the knob.

5. A lighting assembly comprising:

a body comprising a transparent cover connected to a base having a cavity;

an inner platform positioned between the cover and the base and having an opening therethrough;

at least one handle connected to the body;

a raised collar surrounding the opening within the cover;

a light emitting unit having a socket for receiving a light emitting element, the unit slidably positioned inside the base through the opening such that the socket abuts the collar, securing the light emitting element within the platform;

a fastener movably mounted to one of the base or lighting assembly for removably securing the unit within the base wherein the fastener pivotally cooperates with a shoulder on the other of either the base or the light emitting unit for securing and releasing the unit within the cavity; and, a knob pivotably mounted to the base, wherein the knob couples with a controller to selectively supply power to the light emitting element through pivotal movement of the knob.

* * * * *